US011193333B2

(12) United States Patent
Tang et al.

(10) Patent No.: US 11,193,333 B2
(45) Date of Patent: Dec. 7, 2021

(54) AUTOMATIC JET BREAKING TOOL FOR SOLID FLUIDIZATION EXPLOITATION OF NATURAL GAS HYDRATE

(71) Applicants: Southwest Petroleum University, Chengdu (CN); Southern Marine Science and Engineering Guangdong Laboratory (Zhanjiang), Zhanjiang (CN)

(72) Inventors: Yang Tang, Chengdu (CN); Shunxiao Huang, Chengdu (CN); Guorong Wang, Chengdu (CN); Qingyou Liu, Chengdu (CN); Shouwei Zhou, Chengdu (CN); Xushen Li, Zhanjiang (CN); Lin Zhong, Chengdu (CN); Qingping Li, Zhanjiang (CN); Yufa He, Zhanjiang (CN); Zhong Li, Zhanjiang (CN); Yanjun Li, Zhanjiang (CN); Hexing Liu, Zhanjiang (CN); Jianglin Zhu, Zhanjiang (CN); Jiaxin Yao, Chengdu (CN); Jiang Lu, Zhanjiang (CN); Leizhen Wang, Chengdu (CN)

(73) Assignees: Southwest Petroleum University, Chengdu (CN); Southern Marine Science and Engineering Guangdong Laboratory (Zhanjiang), Zhanjiang (CN)

( * ) Notice: Subject to any disclaimer, the term of this patent is extended or adjusted under 35 U.S.C. 154(b) by 0 days.

(21) Appl. No.: 17/079,655

(22) Filed: Oct. 26, 2020

(65) Prior Publication Data

US 2021/0140243 A1 May 13, 2021

(30) Foreign Application Priority Data

Nov. 8, 2019 (CN) ..... 201911087346.9

(51) Int. Cl.
*E21B 7/18* (2006.01)
*E21B 41/00* (2006.01)
*E21B 43/01* (2006.01)

(52) U.S. Cl.
CPC ..... *E21B 7/18* (2013.01); *E21B 41/0099* (2020.05); *E21B 43/01* (2013.01)

(58) Field of Classification Search
CPC ..... E21B 7/18; E21B 41/0099; E21B 43/01
See application file for complete search history.

(56) References Cited

U.S. PATENT DOCUMENTS

| | | | | |
|---|---|---|---|---|
| 6,168,213 | B1 | 1/2001 | Muller | |
| 2018/0347325 | A1 | 12/2018 | Goyeneche | |
| 2020/0190945 | A1* | 6/2020 | Buckland | E21B 34/14 |

FOREIGN PATENT DOCUMENTS

| | | | |
|---|---|---|---|
| CN | 202249987 | U | 5/2012 |
| CN | 102536187 | A | 7/2012 |

(Continued)

*Primary Examiner* — Giovanna Wright
*Assistant Examiner* — Yanick A Akaragwe

(57) ABSTRACT

The present invention provides an automatic jet breaking tool for solid fluidization exploitation of natural gas hydrate, which mainly includes an upper joint, an outer cylinder, an inner sliding sleeve, a lockup sliding sleeve, a thrust bearing, a spring, a jet joint, a telescopic jet sprinkler, a plug block and an extrusion seal ring. The present invention mainly adopts the principle of throttling control pressure to control the position of the inner sliding sleeve by controlling a flow rate of a drilling fluid, so as to turn on and turn off the jet breaking tool. The application of the present invention can realize automatic jet breaking of solid fluidization exploitation of the natural gas hydrate, reduce procedures of a round trip operation, and effectively improve the efficiency and safety of the exploitation operation of the natural gas hydrate.

8 Claims, 13 Drawing Sheets

(56) References Cited

FOREIGN PATENT DOCUMENTS

| | | | |
|---|---|---|---|
| CN | 202745847 | U | 2/2013 |
| CN | 105201476 | A | 12/2015 |
| CN | 108678671 | A | 10/2018 |
| CN | 208734279 | U | 4/2019 |
| CN | 110005379 | A | 7/2019 |

* cited by examiner

AUTOMATIC JET BREAKING TOOL FOR SOLID FLUIDIZATION EXPLOITATION OF NATURAL GAS HYDRATE

CROSS-REFERENCE TO RELATED APPLICATIONS

This application claims priority to Chinese Application No. 201911087346.9, filed on Nov. 8, 2019, entitled "automatic jet breaking tool for solid fluidization exploitation of natural gas hydrate". These contents are hereby incorporated by reference.

TECHNICAL FIELD

The present invention relates to the technical field of jet breaking during exploitation of natural gas hydrate, and particularly to an automatic jet breaking tool for solid fluidization exploitation of natural gas hydrate.

BACKGROUND

Natural gas hydrate, i.e. combustible ice, is an ice-like crystalline substance distributed in deep-sea sediments or in continental permafrost and formed by natural gas and water under high-pressure and low-temperature conditions, which is one of the most concerned energy sources in the world. As a new energy source, it has huge global reserves, is clean and efficient, and plays a crucial role in the future energy strategy. However, its exploitation methods are not yet mature, and the existing exploitation methods are all costly, with poor production sustainability, low efficiency and no safety guarantee, so they cannot be used for commercial exploitation. In terms of the ocean, challenges are even greater, and there is a serious lack of supporting tools and equipment.

In shallow natural gas hydrate exploitation operations in deep seafloor, in order to increase the exposed area of the hydrate and increase the mining quantity and continuous productivity, a conventional bit is generally used for breaking and axial drilling to form a pilot hole, and then injection breaking and circumferential breaking are used to expand the borehole. Currently, the jet breaking tool used in natural gas hydrate exploitation has a simple structure, which cannot meet operation requirements of solid fluidization exploitation of the natural gas hydrate. The main problems are as follows:

(1) When the entire jet breaking tool is in a normal operating state, if the flow rate of the drilling fluid fluctuates too much, the stable operation of the entire jet breaking tool cannot be effectively guaranteed.

(2) When the jet breaking tool is opened or closed, it is not sensitive to control the tool to be turned on and turned off by adjusting the flow rate of the drilling fluid.

(3) When the jet breaking tool is on, the drilling fluid may leak in an axial flow channel, so that the flow rate and pressure of the drilling fluid ejected from the jet sprinkler may be reduced.

(4) When the drilling fluid is ejected from the jet sprinkler, a natural gas hydrate layer cannot be washed more directly, and the breaking radius of the breaking tool is small.

In order to solve the problems in the existing jet breaking tool for shallow natural gas hydrate in deep seafloor, improve exploitation efficiency and exploitation quantity of natural gas hydrate and promote the commercial exploitation process, an automatic jet breaking tool for solid fluidization exploitation of natural gas hydrate is urgently needed, so as to achieve the objective of automatically turning on and turning off the automatic jet breaking tool for solid fluidization exploitation of natural gas hydrate according to an actual exploitation condition of natural gas hydrate. Meanwhile, the jet breaking tool can be sensitively turned on and turned off. When the jet breaking tool for natural gas hydrate is in an operating state, the opening degree of the sliding sleeve is still stable when the flow rate fluctuates, which makes the breaking operation of the jet breaking tool more stable and reliable. An effect is achieved that leakage of the drilling fluid at an axial outlet can be reduced when the automatic jet breaking tool for solid fluidization exploitation of natural gas hydrate is on. When the breaking tool is used for radial breaking, an internal jet nozzle can be extended to enable the drilling fluid to break the natural gas hydrate layer more directly and under a high pressure, so as to achieve the objective of increasing the breaking radius and improving the exploitation efficiency.

SUMMARY OF THE INVENTION

An objective of the present invention is to provide an automatic jet breaking tool for solid fluidization exploitation of natural gas hydrate with respect to problems and requirements of the existing jet breaking tool for shallow natural gas hydrate in deep seafloor, so as to solve the problem of stability of the operation of the jet breaking tool affected by fluctuation of the flow rate of the drilling fluid, achieve an effect of more sensitively turning on and turning off the jet breaking tool, and solve the problem of leakage of the drilling fluid at an axial outlet, thereby increasing the flow rate and pressure of the drilling fluid ejected by the jet sprinkler and improving the breaking efficiency of the jet breaking tool. Meanwhile, the jet breaking tool can control the operating state of the jet breaking tool by adjusting the flow rate of the drilling fluid without repeatedly lifting and lowering the drill string. The jet breaking radius is increased by using a telescopic sprinkler.

To achieve the above objective, the present invention adopts the following technical solution:

An automatic jet breaking tool for solid fluidization exploitation of natural gas hydrate, including: an upper joint (1), an outer cylinder (2), an inner sliding sleeve (3), a lockup sliding sleeve (4), a thrust bearing (5), a spring (6), a jet joint (7), a telescopic jet sprinkler (8), a plug block (9) and an extrusion seal ring (10), wherein the upper joint (1) is located on the leftmost side of the whole device, the outer cylinder (2) is connected to the right side of the upper joint (1) by thread, the inner sliding sleeve (3) is mounted inside the outer cylinder (2), the lockup sliding sleeve (4) is mounted to an outer ring side of the inner sliding sleeve (3), the thrust bearing (5) is disposed on the right side of the lockup sliding sleeve (4), the spring (6) is disposed between the thrust bearing (5) and an inner side of the outer cylinder (2), the jet joint (7) is connected to the right side of the outer cylinder (2) by thread, the plug block (9) is connected to the interior of the jet joint (7) by thread, the telescopic jet sprinkler (8) is connected to an outer ring side of the jet joint (7) by thread, and the extrusion seal ring (10) is mounted to an outer ring side of the plug block (9) through a seal ring mounting groove (901).

Further, the upper joint (1) is designed with a self-locking guide groove (106), an unlocking guide bevel (105) and a locking bevel (107) at a lower end.

Further, the inner sliding sleeve (3) is designed with a self-locking guide block (302), an inner sliding sleeve self-locking bevel (303), a pressure balance hole (304) and a discharge groove (305) on an upper-end outer ring side, and the inner sliding sleeve (3) is designed with an extrusion seal face (307) at the lowest end.

Further, the lockup sliding sleeve (4) is provided with a lockup sliding sleeve bevel (401) and a lockup sliding sleeve guide groove (402) on an outer ring side and is provided with a bearing groove (403) at the lowest end.

Further, the jet joint (7) is provided with 24 sprinkler holes (702) in uniform staggered arrangement on a surface, is internally provided with a sliding passage (703) and a plug block mounting thread (704) and is provided with an annular hollow flow channel (705) at the lowest end.

Further, the telescopic jet sprinkler (8) is internally provided with a jet nozzle (801), and the jet nozzle (801) is internally provided with a pressurized nozzle flow channel (804), is provided with a nozzle spring (805) on an outer side and is provided with a spring stop (806) at a lower end.

Further, the plug block (9) is provided with the seal ring mounting groove (901).

Further, in a normal drilling stage, the inner sliding sleeve (3) is not locked, a jet tool is turned off, and a drilling fluid flows out only through the flow channel (705) for a drilling operation; in a jet breaking stage, a sufficiently large flow rate of the drilling fluid is introduced, the inner sliding sleeve (3) is locked, the jet sprinkler is opened, and the jet nozzle (801) in the telescopic jet sprinkler (8) extends and ejects the drilling fluid for circumferential jet breaking; in an operation stop stage, the flow rate of drilling fluid is first increased to push the inner sliding sleeve (3) to unlock, then reduced and finally stopped, and the inner sliding sleeve (3) rebounds by a thrust of the spring (6), and the jet tool is turned off; in the next jet breaking stage, a sufficiently large flow rate of the drilling fluid is introduced, the inner sliding sleeve (3) is locked, the jet tool is turned on, and the jet nozzle (801) in the telescopic jet sprinkler (8) extends and ejects the drilling fluid for circumferential jet breaking; and in the next operation stop stage, the flow rate of the drilling fluid is first increased to push the inner sliding sleeve (3) to unlock, then reduced and finally stopped, and the inner sliding sleeve (3) rebounds by a thrust of the spring (6), and the jet tool is turned off; in this way, the jet breaking tool is reusable.

Compared with the existing technology, the present invention has the following beneficial effects:

(I) The operating state of the jet breaking tool can be controlled by adjusting the flow rate of the drilling fluid without repeatedly lifting and lowering the drill string.

(II) When the entire jet breaking tool is on or off, the opening degree of the sliding sleeve is still stable when the flow rate fluctuates.

(III) The pressurization principle, pressure balance hole, thrust bearing and other structures are used to increase the axial thrust of the drilling fluid for the inner sliding sleeve and reduce direct friction between internal parts of the jet breaking tool, so that the jet breaking tool is turned on and turned off more conveniently and sensitively.

(IV) The leakage at the axial outlet of the drilling fluid is reduced by extrusion seal, thereby increasing the flow rate and pressure of the drilling fluid ejected by the jet sprinkler and improving the breaking efficiency of the jet breaking tool.

(V) A telescopic jet sprinkler is designed to make the drilling fluid break the natural gas hydrate layer more directly and under a high pressure, so as to increase the breaking radius and improve the exploitation efficiency.

Figure 1:
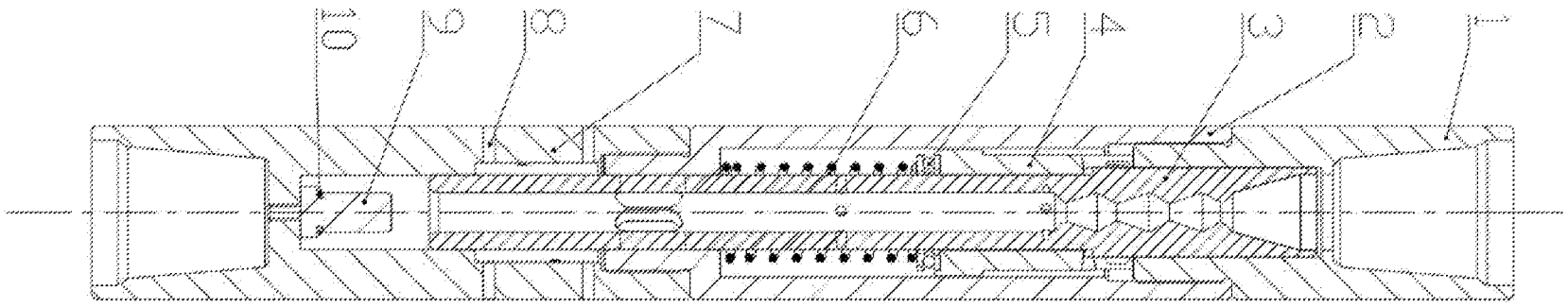
FIG. 1 is a general sectional view of an automatic jet breaking tool for solid fluidization exploitation of natural gas hydrate.
Figure 2:
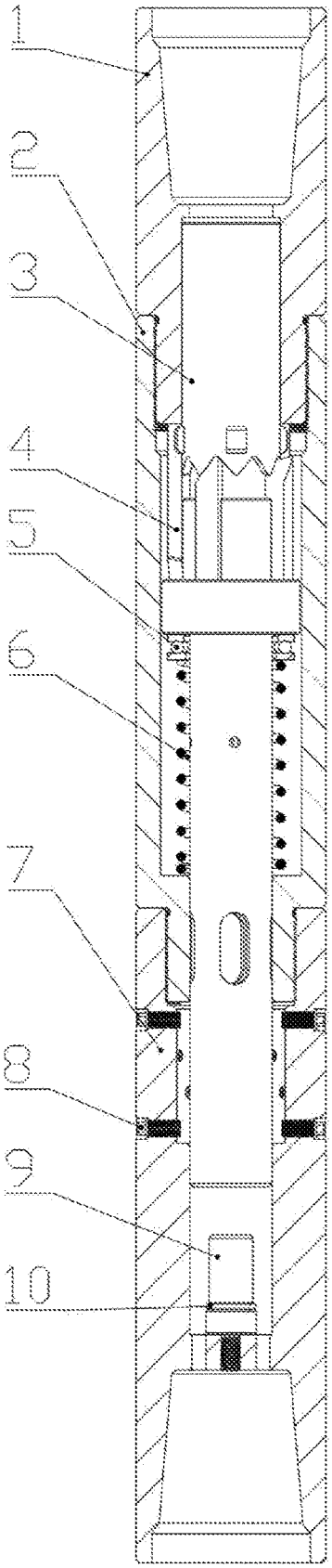
FIG. 2 is a semi-sectional view of an unlock state of the automatic jet breaking tool for solid fluidization exploitation of natural gas hydrate.
Figure 3:
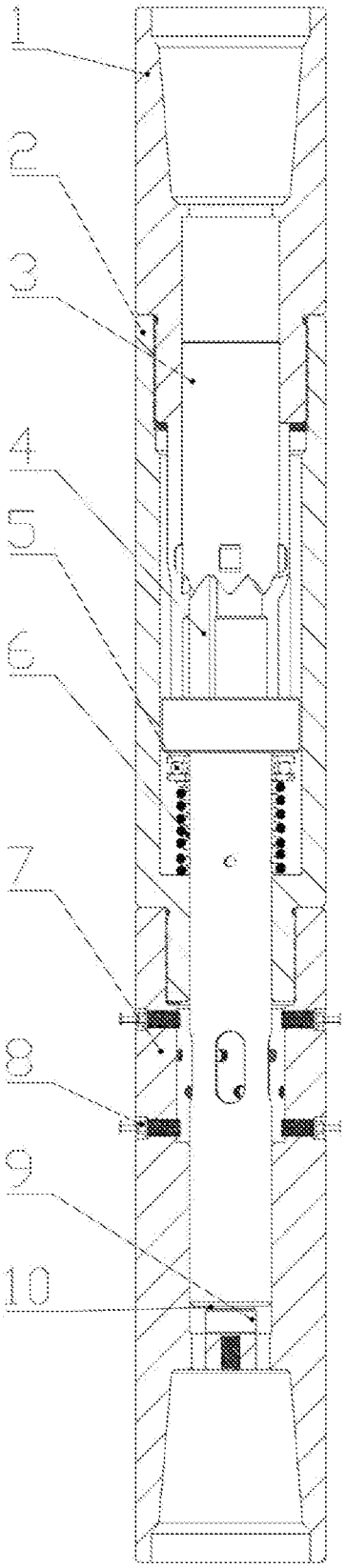
FIG. 3 is a semi-sectional view of a lock state of the automatic jet breaking tool for solid fluidization exploitation of natural gas hydrate.
Figure 4:
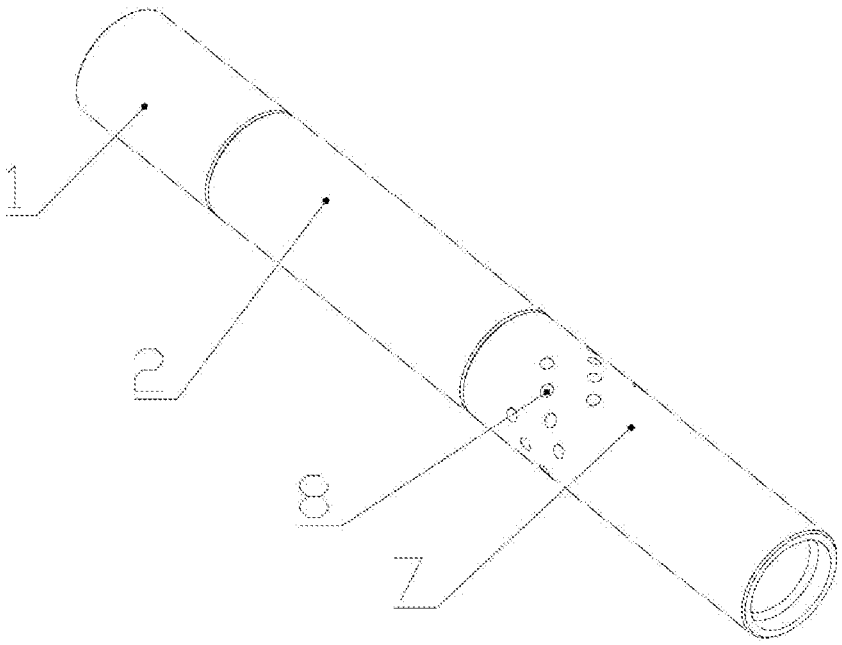
FIG. 4 is a main view of the automatic jet breaking tool for solid fluidization exploitation of natural gas hydrate.

1: upper joint; 101: upper tool interface; 102: diversion port; 103: inner sliding sleeve limit port; 104: upper joint thread; 105: unlocking guide bevel; 106: self-locking guide groove; 107: locking bevel; 2: outer cylinder; 201: outer cylinder upper thread; 202: spring limit port; 203: outer cylinder lower thread; 3: inner sliding sleeve; 301: drilling fluid diversion port; 302: self-locking guide block; 303: inner sliding sleeve self-blocking bevel; 304: pressure balance hole; 305: discharge groove; 306: pressurization flow channel; 307: extrusion seal face; 4: lockup sliding sleeve; 401: lockup sliding sleeve bevel; 402: lockup sliding sleeve guide groove; 403: bearing groove; 5: thrust bearing; 6: spring; 7: jet joint; 701: lower joint thread; 702: sprinkler hole; 703: sliding passage; 704: plug block mounting thread; 705: flow channel; 706: axial flow hole; 8: telescopic jet sprinkler; 801: jet nozzle; 802: nozzle limit surface; 803: nozzle spring limit surface; 804: nozzle pressurization flow channel; 805: nozzle spring; 806: spring limit block; 807: jet sprinkler thread; 9: plug block; 901: seal ring mounting groove; 902: plug block thread; 10: extrusion seal ring.

DETAILED DESCRIPTION OF PREFERRED EMBODIMENTS

As shown in FIGS. 1-4, an automatic jet breaking tool for solid fluidization exploitation of natural gas hydrate includes an upper joint (1), an outer cylinder (2), an inner sliding sleeve (3), a lockup sliding sleeve (4), a thrust bearing (5), a spring (6), a jet joint (7), a telescopic jet sprinkler (8), a plug block (9) and an extrusion seal ring (10), the upper joint (1) is located on the leftmost side of the whole device, the outer cylinder (2) is connected to the right side of the upper joint (1) by thread, the inner sliding sleeve (3) is mounted inside the outer cylinder (2), the lockup sliding sleeve (4) is mounted to an outer ring side of the inner sliding sleeve (3), the thrust bearing (5) is disposed on the right side of the lockup sliding sleeve (4), the spring (6) is disposed between the thrust bearing (5) and an inner side of the outer cylinder (2), the jet joint (7) is connected to the right side of the outer cylinder (2) by thread, the plug block (9) is connected to the interior of the jet joint (7) by thread, the telescopic jet sprinkler (8) is connected to an outer ring side of the jet joint (7) by thread, and the extrusion seal ring (10) is mounted to an outer ring side of the plug block (9) through a seal ring mounting groove (901).

Figure 5:
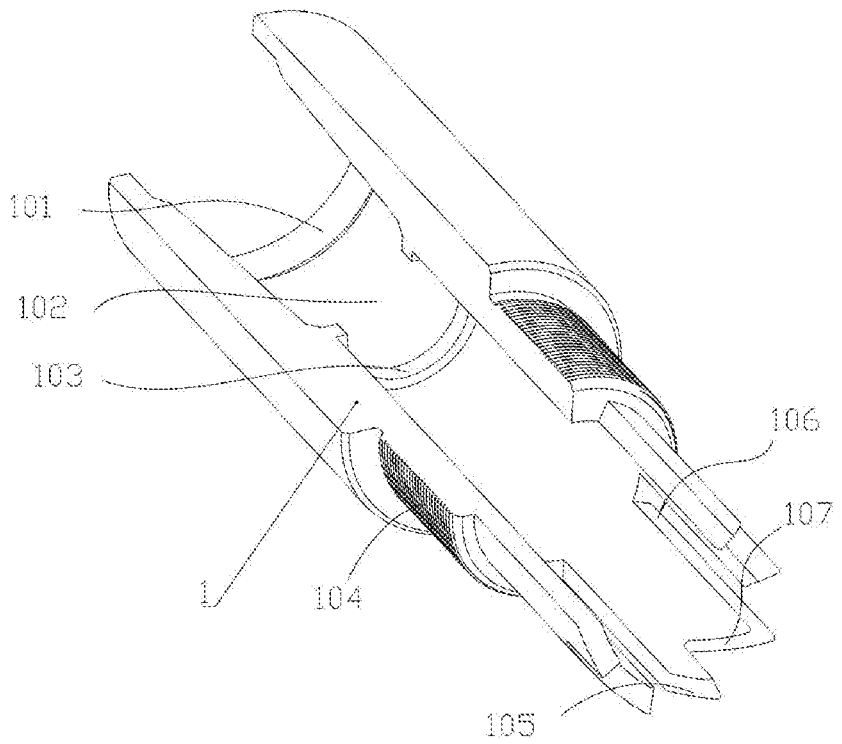
FIG. 5 is a three-fourth sectional view of an upper joint.

As shown in FIG. 5, the upper joint (1) is designed with an upper tool interface (101), a diversion port (102), an inner sliding sleeve limit port (103), an upper joint thread (104), an unlocking guide bevel (105), a self-locking guide groove (106) and a locking bevel (107), and the upper joint thread (104) is used to connect to the outer cylinder (2).

Figure 6:
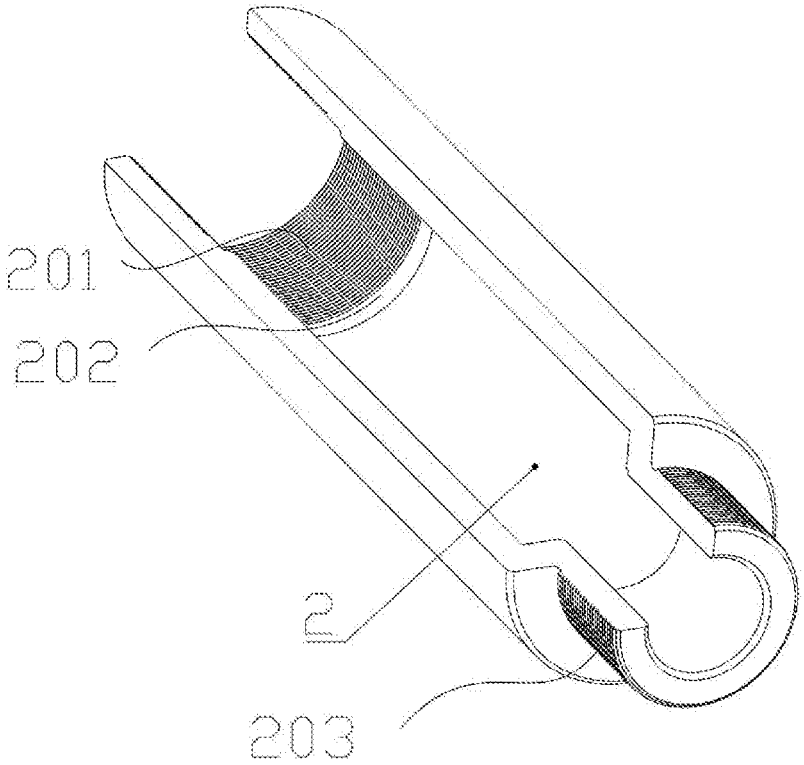
FIG. 6 is a three-fourth sectional view of an outer cylinder.

As shown in FIG. 6, the outer cylinder (2) is designed with a drilling fluid upper thread (201), a spring limit port (202) and an outer cylinder lower thread (203), the outer cylinder upper thread (201) is used to connect to the upper joint (1), the spring limit port (202) is used to hold the spring (6), and the outer cylinder lower thread (203) is used to connect to the lower jet joint (7).

Figure 7:
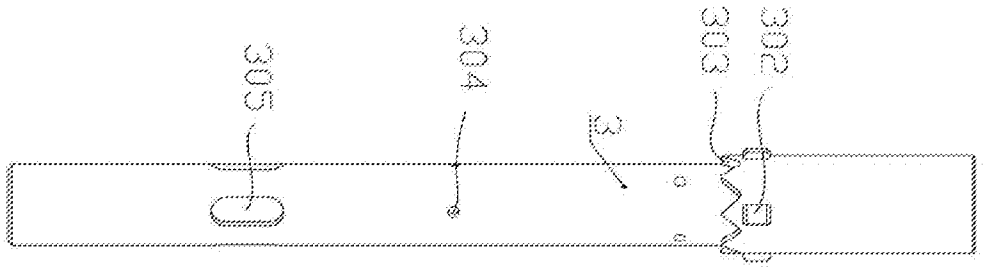
FIG. 7 is a front view of an inner sliding sleeve.
Figure 8:
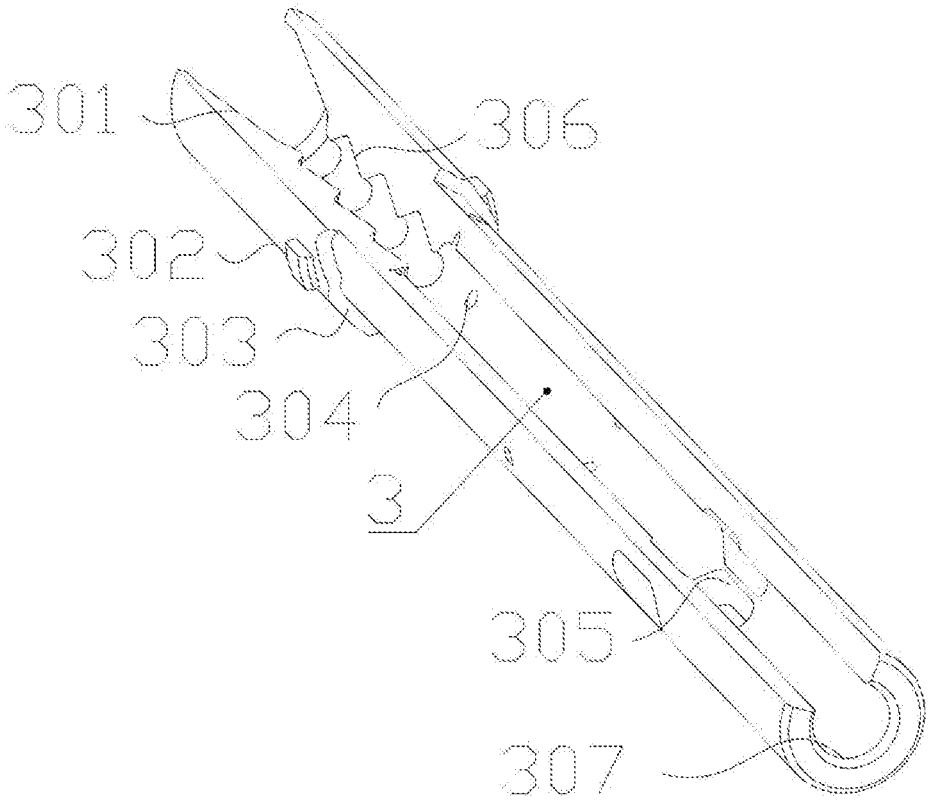
FIG. 8 is a three-fourth sectional view of the inner sliding sleeve.

As shown in FIGS. 7-8, the inner sliding sleeve (3) is designed with a drilling fluid diversion port (301), a self-locking guide block (302), an inner sliding sleeve self-blocking bevel (303), a pressure balance hole (304), a discharge groove (305), a pressurization flow channel (306) and an extrusion seal face (307). The drilling fluid diversion port (301) pressurizes the drilling fluid into the inner sliding sleeve (3). The pressurization flow channel (306) can convert more fluid power into an axial thrust for the inner sliding sleeve and increase the pressure of the drilling fluid entering the inner sliding sleeve. The pressure balance hole (304) can balance the pressure between the inner sliding sleeve (3) and the outer cylinder (2), which makes the axial thrust of the drilling fluid acting on the inner sliding sleeve (3) greater. The function of the discharge groove (305) is that the drilling fluid flows through the discharge groove (305) towards the telescopic jet sprinkler (8) and is ejected out when the jet tool is turned on. When the inner sliding sleeve (3) moves downward and the jet tool is on, the extrusion seal face (307) and the extrusion seal ring (10) deform to achieve a sealing effect.

Figure 9:
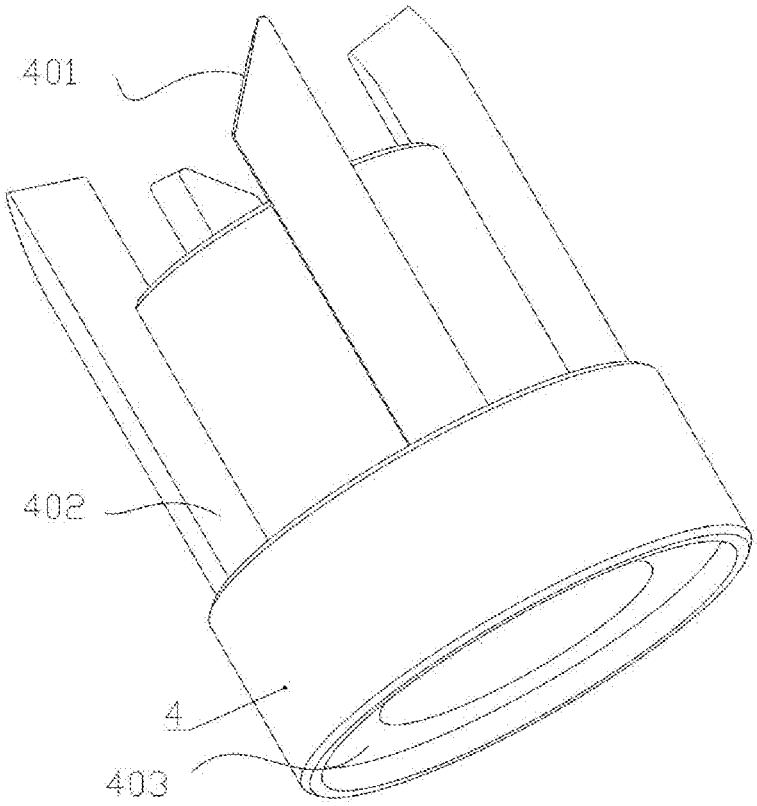
FIG. 9 is a main view of a lockup sliding sleeve.

As shown in FIG. 9, the lockup sliding sleeve (4) is uniformly provided with a lockup sliding sleeve bevel (401), a lockup sliding sleeve guide groove (402) and a bearing groove (403), the thrust bearing (5) is disposed in the bearing groove (403), one side of the spring (6) abuts against the thrust bearing (5), and the other side abuts against the spring limit port (202).

Figure 10:
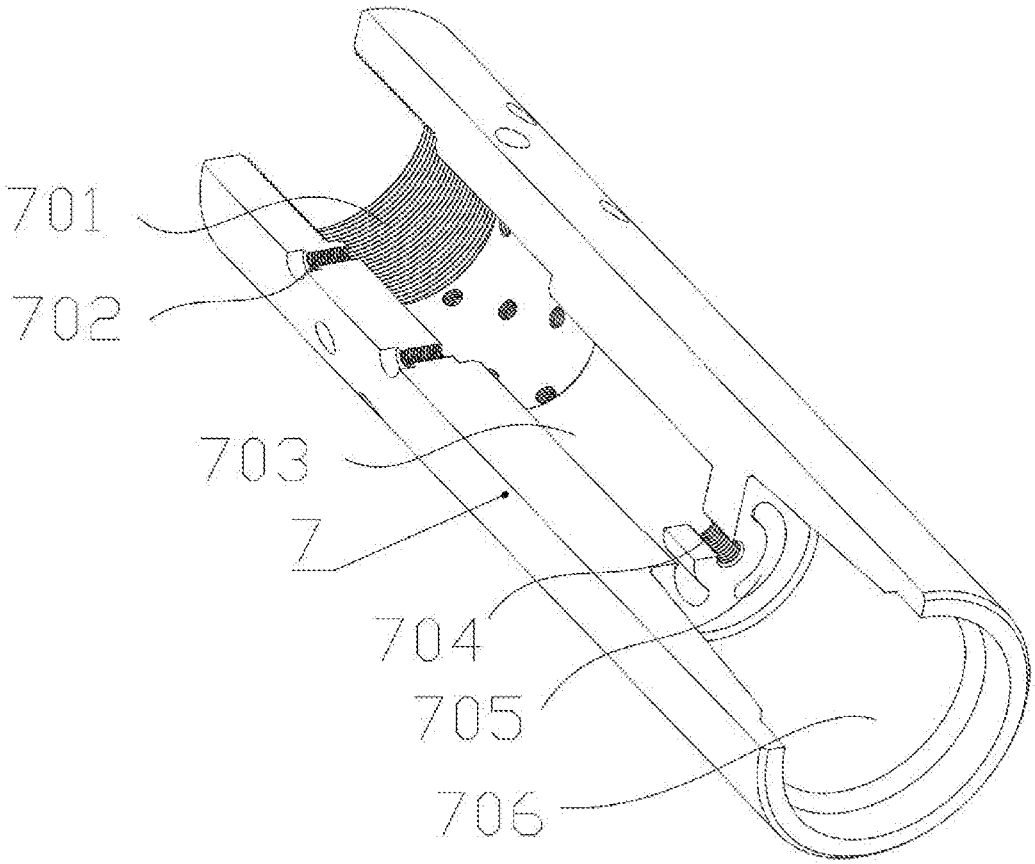
FIG. 10 is a three-fourth sectional view of a jet joint.

As shown in FIG. 10, the jet joint (7) is provided with a sprinkler hole (702) on a surface, and is internally provided with a lower joint thread (701), a sliding passage (703), a plug block mounting thread (704), a flow channel (705) and an axial flow hole (706). The lower joint thread (701) is used to connect to the outer cylinder (2). The sprinkler hole (702) is used to mount the telescopic jet sprinkler (8). The inner diameter of the sliding passage (703) is the same as the outer diameter of the lower end of the inner sliding sleeve (3), and the two match with each other to achieve the purpose of sealing. The plug block mounting thread (704) is used to mount the plug block (9). When the inner sliding sleeve (3) is unlocked, the drilling fluid can be circulated in the flow channel (705). The axial flow hole (706) can make the diffusion radius of the drilling fluid flowing through the flow channel (705) larger, which achieves a good breaking drilling effect.

Figure 11:
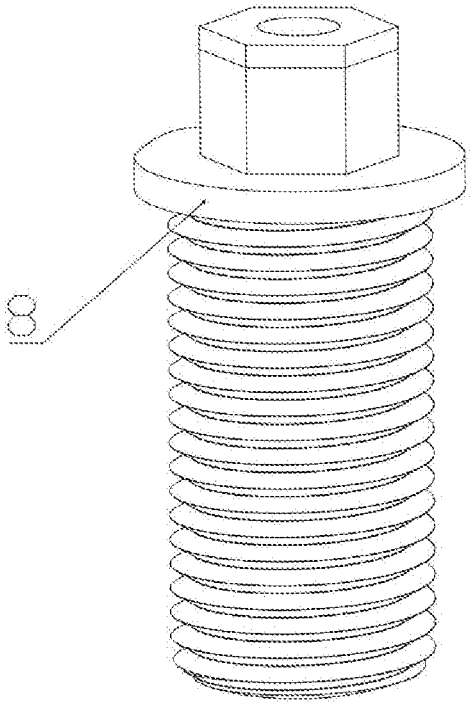
FIG. 11 is a main view of a jet sprinkler.
Figure 12:
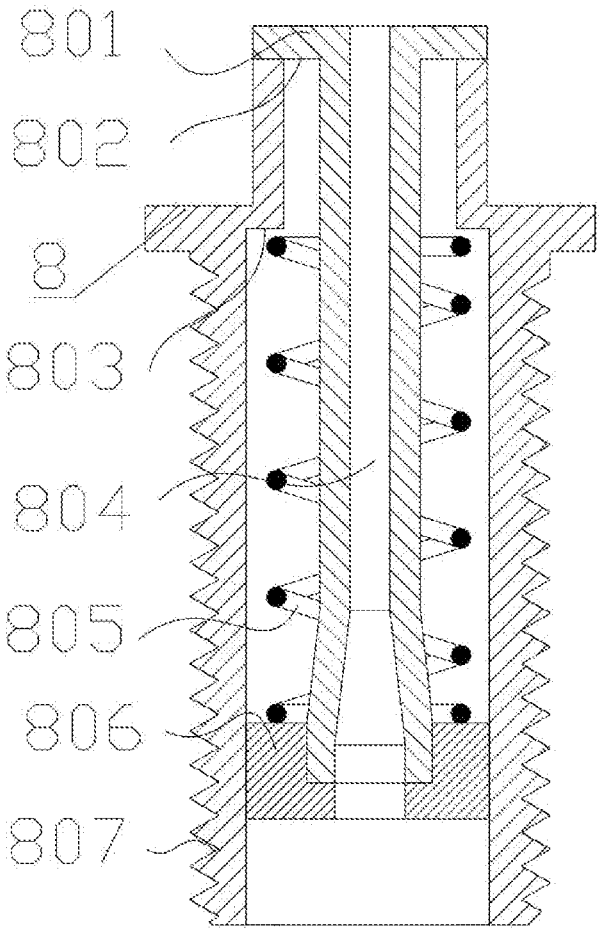
FIG. 12 is a sectional view of the jet sprinkler.

As shown in FIGS. 11-12, the telescopic jet sprinkler (8) is provided with a jet nozzle (801), a nozzle limit surface (802), a nozzle spring limit surface (803), a nozzle pressurization flow channel (804), a nozzle spring (805), a spring limit block (806), and a jet sprinkler thread (807). The jet nozzle (801) is internally provided with the nozzle pressurization flow channel (804) to increase the pressure of the drilling fluid. The function of the nozzle limit surface (802) is to hold the jet nozzle (801) when the jet nozzle (801) rebounds. The nozzle spring (805) is mounted to an outer ring side of the jet nozzle (801), and simultaneously holds the nozzle spring limit surface (803) and the spring limit block (806). The spring limit block (806) is connected to the jet nozzle (801) by thread. When the jet breaking tool is on, the drilling fluid is ejected from the telescopic jet sprinkler (8). Under the pressure of the drilling fluid, the jet nozzle (801) overcomes an elastic force of the nozzle spring (805) to extend outward, making the breaking radius of the jet breaking tool larger and the exploitation efficiency higher. When the jet breaking tool is off, no drilling fluid passes through the jet nozzle (801), and the jet nozzle (801) is returned to its position by a rebound force of the nozzle spring (805).

Figure 13:
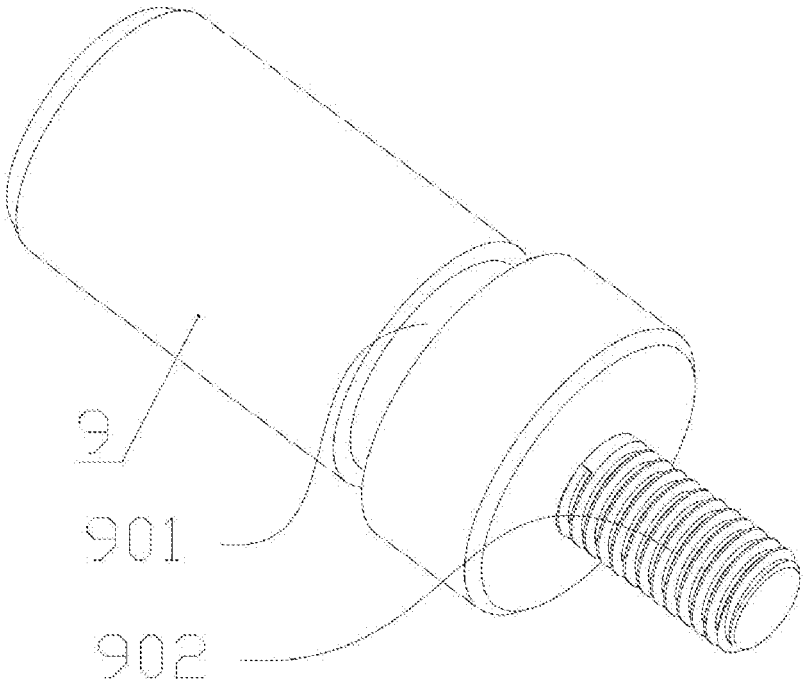
FIG. 13 is a main view of a plug block.

As shown in FIG. 13, the plug block (9) is provided with a seal ring mounting groove (901) on a ring side and is provided with a plug block thread (902) at a lower end. The plug block thread (902) is used to connect to the plug block mounting thread (704). The seal ring mounting groove (901) is used to mount the extrusion seal ring (10). When the inner sliding sleeve (3) is locked, the extrusion seal face (307) and the extrusion seal ring (10) deform to achieve a sealing effect.

In the initial drilling process, the automatic jet breaking tool for solid fluidization exploitation of natural gas hydrate is initially in an unlocked state, in which case the inner sliding sleeve (3) is located at an upper end, the self-locking guide block (302) on the surface of the inner sliding sleeve (3) is located in the self-locking guide groove (106) at the lower end of the upper joint (1), the lockup sliding sleeve bevel (401) on the lockup sliding sleeve (4) is also located in the self-locking guide groove (106), and the tip position of the lockup sliding sleeve bevel (401) is at half of the inner sliding sleeve self-locking bevel (303) on the surface of the inner sliding sleeve (3). In the unlocked state, the drilling fluid flows from the flow channel (705) to the axial flow hole (706) for axially breaking the natural gas hydrate layer. When the flow rate of the drilling fluid increases to a certain extent, the axial thrust received by the inner sliding sleeve (3) increases to a certain value, so that the inner sliding sleeve (3) overcomes the thrust of the spring (6) to move down, and the self-locking guide block (302) on the surface of the inner sliding sleeve (3) moves along the self-locking guide groove (106) at the lower end of the upper joint (1) and eventually moves out of the self-locking guide groove (106). When the flow rate of the drilling fluid increases and then returns to a smaller value, the original tip position of the lockup sliding sleeve bevel (401) is at half of the inner sliding sleeve self-locking bevel (303) on the surface of the inner sliding sleeve (3). Without the constraint of the self-locking guide groove (106), the tip position of the lockup sliding sleeve bevel (401) slides down the inner sliding sleeve self-locking bevel (303) on the surface of the inner sliding sleeve (3) to the bottom end of the inner sliding sleeve self-locking bevel (303), and when the flow rate of the drilling fluid further decreases, the axial thrust received by the inner sliding sleeve (3) decreases and the lockup sliding sleeve bevel (401) slides along the locking bevel (107) and eventually stops at the bottom end of the locking bevel (107). In this case, due to the constraint of the locking bevel (107), even if the flow rate of the drilling fluid is reduced, the inner sliding sleeve (3) is still located at the lower end, the automatic jet breaking tool for solid fluidization exploitation of natural gas hydrate is on, and the drilling fluid flows through the discharge groove (305) to the telescopic jet sprinkler (8) and ejects, for circumferentially breaking the natural gas hydrate layer. When the flow rate of the drilling fluid increases to a certain extent again, the axial thrust received by the inner sliding sleeve (3) increases to a certain value, so that the inner sliding sleeve (3) overcomes the thrust of the spring (6) to move down, and the self-locking guide block (302) on the surface of the inner sliding sleeve (3) moves axially along the locking bevel (107) at the lower end of the upper joint (1) and eventually moves out of the locking bevel (107). When the flow rate of the drilling fluid increases and then returns to a smaller value, the original tip position of the lockup sliding sleeve bevel (401) is at half of the inner sliding sleeve self-locking bevel (303) on the surface of the inner sliding sleeve (3). Without the constraint of the locking bevel (107), the tip position of the lockup sliding sleeve bevel (401) slides down the inner sliding sleeve self-locking bevel (303) on the surface of the inner sliding sleeve (3) to the bottom end of the inner sliding sleeve self-locking bevel (303), and when the flow rate of the drilling fluid further decreases, the axial thrust received by the inner sliding sleeve (3) decreases and the lockup sliding sleeve bevel (401) slides along the unlocking guide bevel (105) and eventually falls into the self-locking guide groove (106) and slides along the self-locking guide groove (106) to stop at its lowest end. In this case, the inner sliding sleeve (3) is located at the upper end, the automatic jet breaking tool for solid fluidization exploitation of natural gas hydrate returns to the unlocked state, the drilling fluid flows from the flow channel (705) to the axial flow hole (706) for axially breaking the natural gas hydrate layer. Thus, the automatic jet breaking tool for solid fluidization exploitation of natural gas hydrate is turned on and turned off by controlling the flow rate of the drilling fluid, so as to change the form of breaking the natural gas hydrate layer.

What is claimed is:

1. An automatic jet breaking tool for solid fluidization exploitation of natural gas hydrate, comprising: an upper joint (1), an outer cylinder (2), an inner sliding sleeve (3), a lockup sliding sleeve (4), a thrust bearing (5), a spring (6), a jet joint (7), a telescopic jet sprinkler (8), a plug block (9) and an extrusion seal ring (10), wherein the upper joint (1) is located on the leftmost side of the whole device, the outer cylinder (2) is connected to the right side of the upper joint (1) by thread, the inner sliding sleeve (3) is mounted inside the outer cylinder (2), the lockup sliding sleeve (4) is mounted to an outer ring side of the inner sliding sleeve (3), the thrust bearing (5) is disposed on the right side of the lockup sliding sleeve (4), the spring (6) is disposed between the thrust bearing (5) and an inner side of the outer cylinder (2), the jet joint (7) is connected to the right side of the outer cylinder (2) by thread, the plug block (9) is connected to the interior of the jet joint (7) by thread, the telescopic jet sprinkler (8) is connected to an outer ring side of the jet joint (7) by thread, and the extrusion seal ring (10) is mounted to an outer ring side of the plug block (9) through a seal ring mounting groove (901).

2. The automatic jet breaking tool for solid fluidization exploitation of natural gas hydrate according to claim 1, wherein the upper joint (1) is provided with a self-locking guide groove (106), an unlocking guide bevel (105) and a locking bevel (107) at a lower end.

3. The automatic jet breaking tool for solid fluidization exploitation of natural gas hydrate according to claim 1, wherein the inner sliding sleeve (3) is designed with a self-locking guide block (302), an inner sliding sleeve self-locking bevel (303), a pressure balance hole (304) and a discharge groove (305) on an upper-end outer ring side, and the inner sliding sleeve (3) is designed with an extrusion seal face (307) at the lowest end.

4. The automatic jet breaking tool for solid fluidization exploitation of natural gas hydrate according to claim 1, wherein the lockup sliding sleeve (4) is provided with a lockup sliding sleeve bevel (401) and a lockup sliding sleeve guide groove (402) on an outer ring side and is provided with a bearing groove (403) at the lowest end.

5. The automatic jet breaking tool for solid fluidization exploitation of natural gas hydrate according to claim 1, wherein the jet joint (7) is provided with 24 sprinkler holes (702) in uniform staggered arrangement on a surface, is internally provided with a sliding passage (703) and a plug block mounting thread (704) and is provided with an annular hollow flow channel (705) at the lowest end.

6. The automatic jet breaking tool for solid fluidization exploitation of natural gas hydrate according to claim 1, wherein the telescopic jet sprinkler (8) is internally provided with a jet nozzle (801), and the jet nozzle (801) is internally provided with a pressurized nozzle flow channel (804), is provided with a nozzle spring (805) on an outer side and is provided with a spring stop (806) at a lower end.

7. The automatic jet breaking tool for solid fluidization exploitation of natural gas hydrate according to claim 1, wherein the plug block (9) is provided with the seal ring mounting groove (901).

8. The automatic jet breaking tool for solid fluidization exploitation of natural gas hydrate according to claim 1, wherein in a normal drilling stage, the inner sliding sleeve (3) is not locked, a jet tool is turned off, and a drilling fluid flows out only through the flow channel (705) for a drilling operation; in a jet breaking stage, a sufficiently large flow rate of the drilling fluid is introduced, the inner sliding sleeve (3) is locked, the jet sprinkler is opened, and the jet nozzle (801) in the telescopic jet sprinkler (8) extends and ejects the drilling fluid for circumferential jet breaking; in an operation stop stage, the flow rate of the drilling fluid is first increased to push the inner sliding sleeve (3) to unlock, then reduced and finally stopped, and the inner sliding sleeve (3) rebounds by a thrust of the spring (6), and the jet tool is turned off; in the next jet breaking stage, a sufficiently large flow rate of the drilling fluid is introduced, the inner sliding sleeve (3) is locked, the jet tool is turned on, and the jet nozzle (801) in the telescopic jet sprinkler (8) extends and ejects the drilling fluid for circumferential jet breaking; and in the next operation stop stage, the flow rate of the drilling fluid is first increased to push the inner sliding sleeve (3) to unlock, then reduced and finally stopped, and the inner sliding sleeve (3) rebounds by a thrust of the spring (6), and the jet tool is turned off; in this way, the jet breaking tool is reusable.

* * * * *